US010190739B2

(12) United States Patent
Hsieh

(10) Patent No.: US 10,190,739 B2
(45) Date of Patent: Jan. 29, 2019

(54) LAMP

(71) Applicant: HABITEX CORPORATION, Taipei (TW)

(72) Inventor: Pei-Lin Hsieh, Taipei (TW)

(73) Assignee: HABITEX CORPORATION, Taipei (TW)

( * ) Notice: Subject to any disclaimer, the term of this patent is extended or adjusted under 35 U.S.C. 154(b) by 0 days.

(21) Appl. No.: 15/614,079

(22) Filed: Jun. 5, 2017

(65) Prior Publication Data

US 2018/0347769 A1 Dec. 6, 2018

(51) Int. Cl.

| | |
|---|---|
| ***F21V 23/04*** | (2006.01) |
| ***F21S 8/04*** | (2006.01) |
| ***F21V 23/00*** | (2015.01) |
| ***H05B 37/02*** | (2006.01) |
| *F21S 8/00* | (2006.01) |

(52) U.S. Cl.

CPC ..... *F21S 8/04* (2013.01); *F21S 8/043* (2013.01); *F21S 8/046* (2013.01); *F21V 23/00* (2013.01); *H05B 37/02* (2013.01); *F21S 8/00* (2013.01)

(58) Field of Classification Search

CPC .... F21S 8/04; F21S 8/043; F21S 8/046; F21S 8/00; F21V 23/00; F21V 23/04; F21V 23/0414; F21V 23/0428; F21V 23/004; F21V 23/008; F21V 23/007; F21V 23/023; F21V 23/02; F21V 23/0421; F21V 14/02; F21V 14/025; H05B 37/02; H01H 19/00

See application file for complete search history.

(56) References Cited

U.S. PATENT DOCUMENTS

| | | | | |
|---|---|---|---|---|
| 2,524,638 A * | 10/1950 | Salad | F21V 23/04 | 362/280 |
| 3,805,050 A * | 4/1974 | Spiegel | F21V 23/04 | 362/189 |
| 6,305,820 B1 * | 10/2001 | Poon | F21V 17/007 | 362/186 |
| 2002/0023826 A1 * | 2/2002 | Miwa | H01H 25/065 | 200/4 |
| 2010/0053942 A1 * | 3/2010 | Tarter | F21V 23/0414 | 362/182 |

* cited by examiner

*Primary Examiner* — Y M. Lee

(74) *Attorney, Agent, or Firm* — Hamre, Schumann, Mueller & Larson, P.C.

(57) ABSTRACT

A lamp includes a base unit and a shade unit. The base unit includes a case body, push button and rotary switches, and an interconnect member connected to the rotary switch. The shade unit includes a shade body connected to the interconnect member, a light module and a connect member. The shade unit is slidable along the interconnect member between a switch-on position, where the connect member is spaced apart from the pushbutton switch so that the light module is switched on and the shade body is rotatable to rotate the rotary switch to adjust brightness of the light module, and a switch-off position, where the connect member abuts against the pushbutton switch so that the light module is switched off.

9 Claims, 5 Drawing Sheets

LAMP

FIELD

The disclosure relates to a lamp, and more particularly to a lamp that can be easily switched on and off, and that has an easily adjustable brightness.

BACKGROUND

Lamps are widely used in modern society in terms of illumination, decoration and even entertainment. It is desired to develop a lamp that can be easily switched on and off, and that has an easily adjustable brightness.

SUMMARY

Therefore, an object of the present disclosure is to provide a lamp that can be operated with relative ease.

According to the present disclosure, a lamp includes a base unit and a shade unit.

The base unit includes a case body, a circuit board, a pushbutton switch, a rotary switch and an elongate interconnect member.

The case body has an opening. The circuit board is disposed in the case body. The pushbutton switch is disposed on the circuit board. The rotary switch is disposed on the circuit board and corresponds in position to the opening. The elongate interconnect member is co-rotatably connected to the rotary switch and extends into the opening.

The shade unit includes a shade body, a light module and a connect member.

The shade body is co-rotatably connected to the elongate interconnect member and is slidable along the elongate interconnect member relative to the case body of the base unit. The light module is disposed in the shade body, and is electrically connected to the pushbutton switch and the rotary switch. The connect member extends from the shade body and is movable toward and away from the pushbutton switch.

The shade unit is slidable along the elongate interconnect member relative to the case body between a switch-on position and a switch-off position. When the shade unit is at the switch-on position, the connect member is spaced apart from the pushbutton switch so that the light module is switched on and emits light, and the shade body is rotatable relative to the case body to rotate the elongate interconnect member and the rotary switch to adjust brightness of the light module. When the shade unit is at the switch-off position, the connect member abuts against the pushbutton switch so that the light module is switched off.

BRIEF DESCRIPTION OF THE DRAWINGS

Other features and advantages of the present disclosure will become apparent in the following detailed description of the exemplary embodiment with reference to the accompanying drawings, of which.

DETAILED DESCRIPTION

Figure 1:
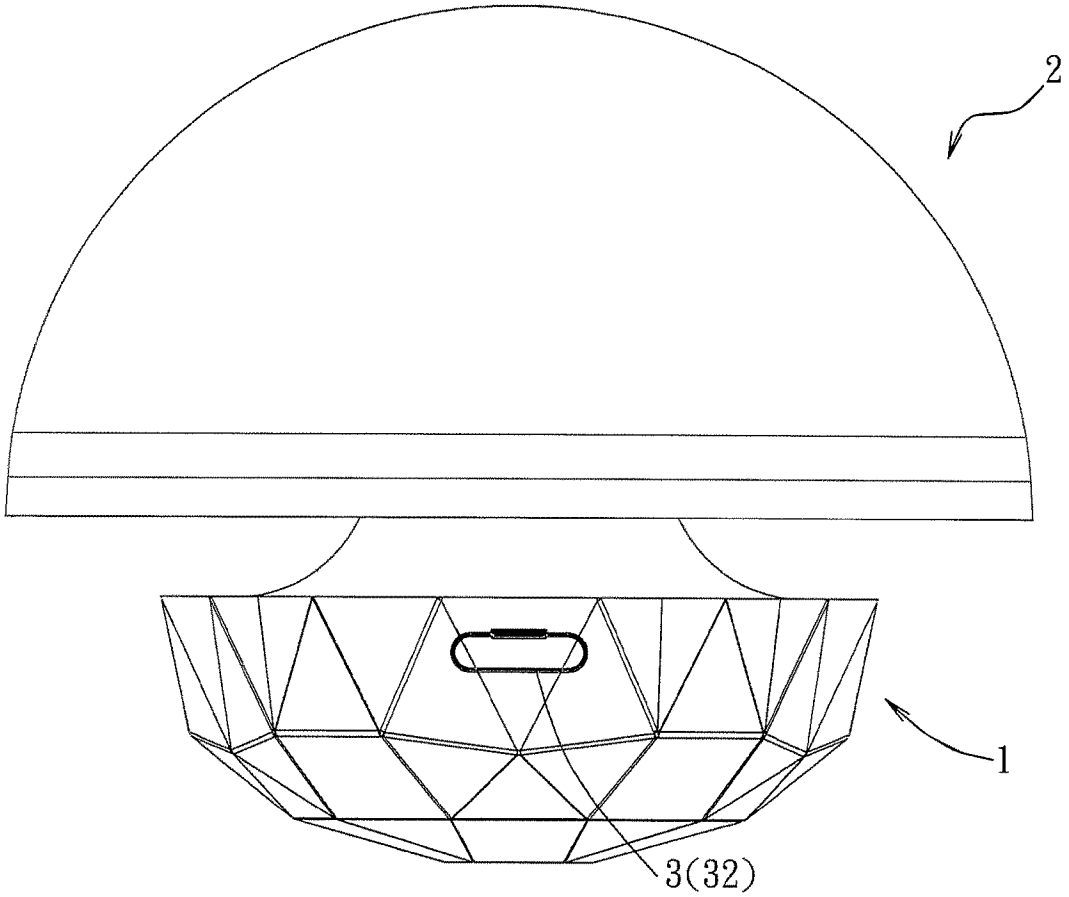
FIG. 1 is a side view of an exemplary embodiment of a lamp accordingly to the present disclosure when a shade unit of the embodiment is at a switch-off position.
Figure 2:
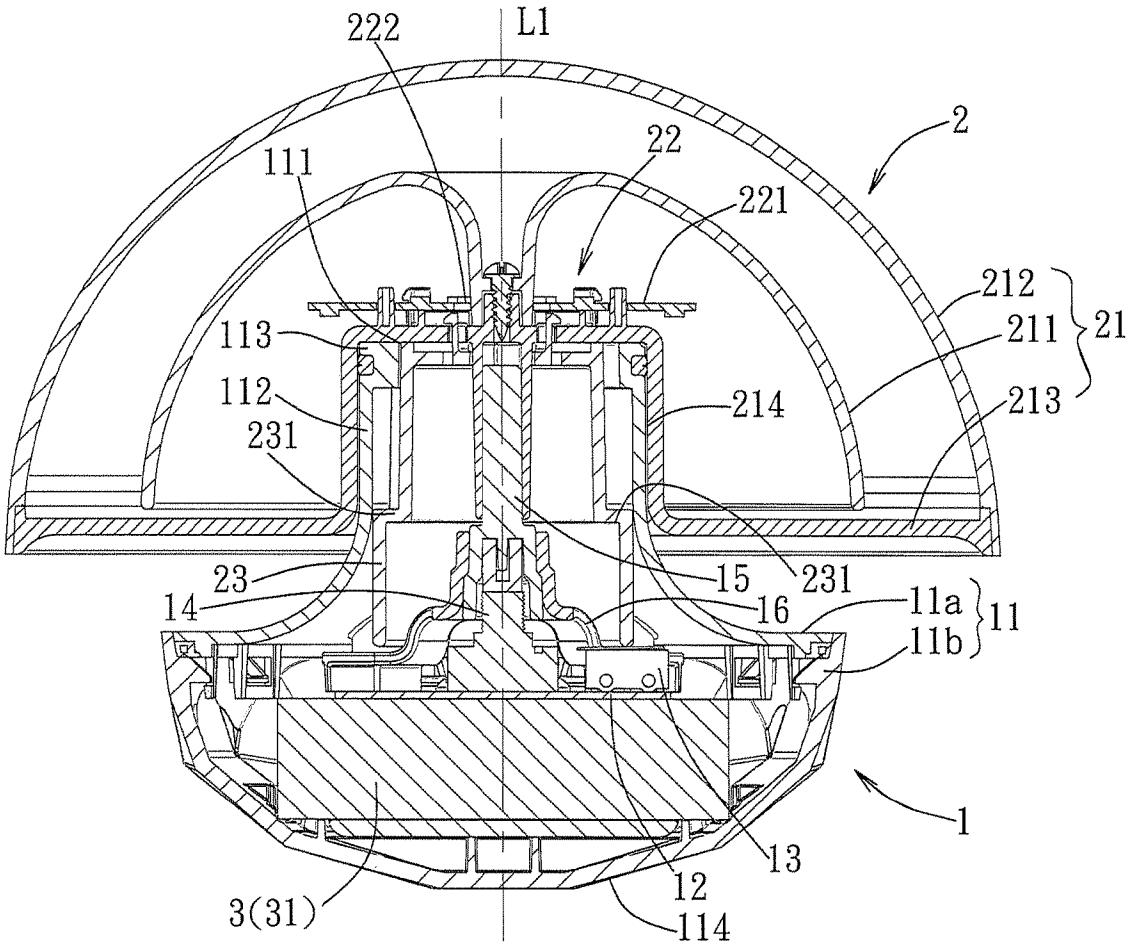
FIG. 2 is a sectional view of the embodiment when the shade unit is at the switch-off position.
Figure 3:
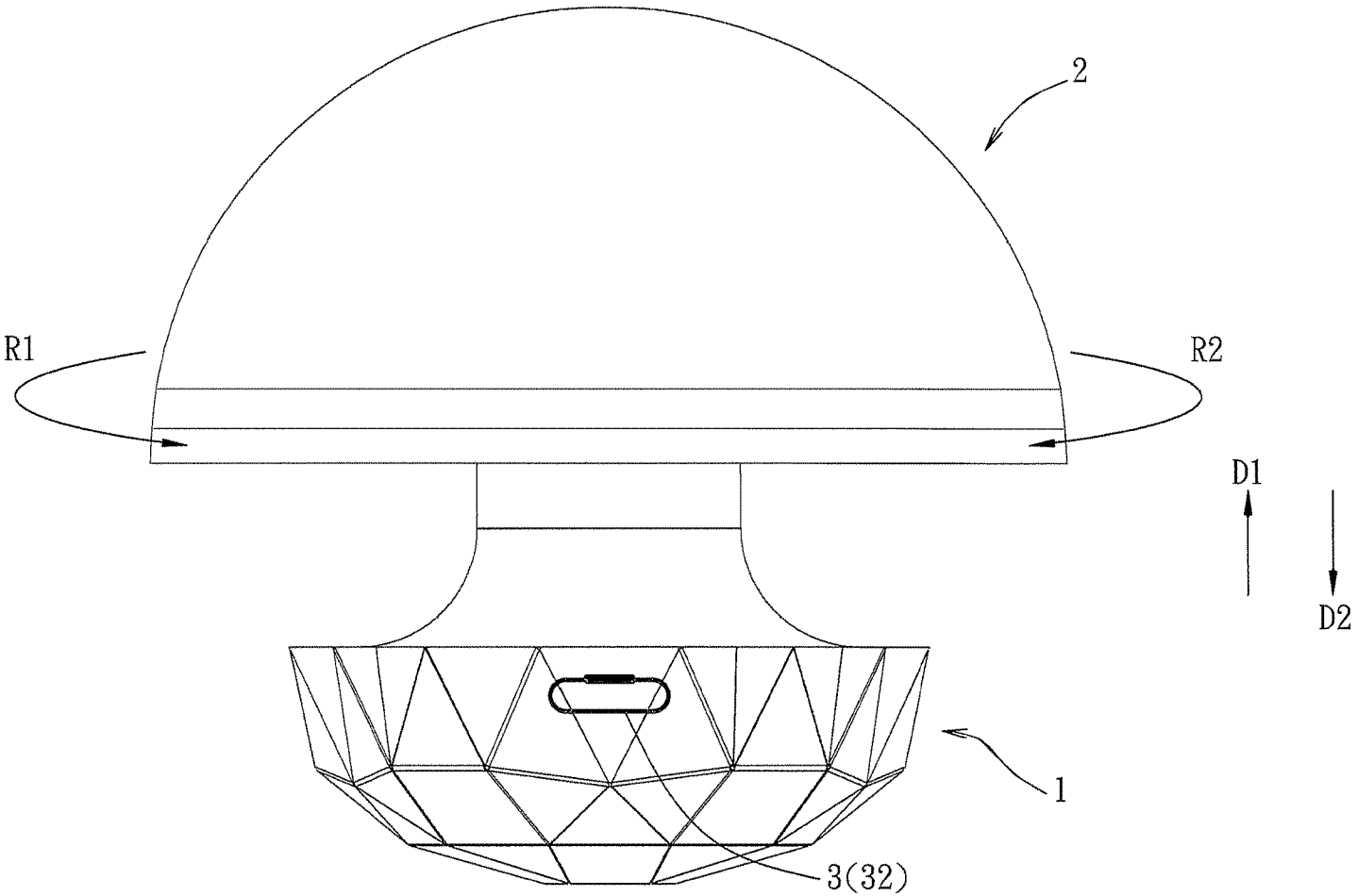
FIG. 3 is a side view of the embodiment when the shade unit is at a switch-on position.

Referring to FIGS. 1, 2 and, an exemplary embodiment of a lamp according to the present disclosure includes a base unit 1, a shade unit 2 and a power supply unit 3.

The base unit 1 includes a case body 11, a first circuit board 12, a pushbutton switch 13, a rotary switch 14, an elongate interconnect member 15 and a support member 16.

The case body 11 defines a central axis (L1), and has an opening 111 and an annular top end 112. The annular top end 112 is formed with an inner flange 113 that surrounds the opening 111 and that extends radially and inwardly toward the central axis (L1). In this embodiment, the case body 11 is exemplified to include an upper case 11*a* and a lower case 11*b*. The upper case 11*a* has the opening 111 and the annular top end 112. The lower case 11*b* has a curved bottom surface 114 (i.e., the case body 11 has the curved bottom surface 114).

The first circuit board 12 is disposed in the case body 11 and below the opening 111.

The pushbutton switch 13 is disposed on the first circuit board 12. In this embodiment, the pushbutton switch 13 is exemplified to be a push-to-break switch, and may be changed according to practical requirements.

The rotary switch 14 is disposed on the first circuit board 12, corresponds in position to the opening 111, and is centered at the central axis (L1).

The elongate interconnect member 15 has an end co-rotatably connected to the rotary switch 14, and extends into the opening 111. When the elongate interconnect member 15 is rotated, the rotary switch 14 is driven co-rotatably by the elongate interconnect member 15.

The support member 16 is fixedly disposed on the first circuit board 12, and the elongate interconnect member 15 extends through the support member 16, so as to prevent the elongate interconnect member 15 from being tilted or displaced.

The shade unit 2 includes a shade body 21, a light module 22 and a connect member 23.

The shade body 21 is co-rotatably connected to an end of the elongate interconnect member 15 distal from the rotary switch 14 and is slidable along the elongate interconnect member 15 relative to the case body 11 of the base unit 1. The shade body 21 has an inner shade layer 211, and an outer shade layer 212 spaced apart from and covering the inner shade layer 211. In this embodiment, the shade body 21 further has a bottom layer 213 that is connected to a bottom end of the inner shade layer 211 and a bottom end of the outer shade layer 212, and that is formed with a recess 214 indented toward the inner shade layer 211.

The light module 22 is disposed in the shade body 21, is electrically connected to the pushbutton switch 13 and the rotary switch 14, and includes a second circuit board 221 and at least one light-emitting diode 222 disposed on the second circuit board 221. In this embodiment, the light module 22 includes a plurality of the light-emitting diodes 222. Alternatively, the light-emitting diodes 222 may be replaced with at least one incandescent light bulb (not shown), based on actual requirements.

It is worth mentioning that the double layer design of the inner shade layer 211 and the outer shade layer 212 allows the light emitted by the light-emitting diodes 222 to be reflected and refracted therebetween, resulting in a softer light.

The connect member 23 extends from the shade body 21 and is movable toward and away from the pushbutton switch 13. Specifically, the connect member 23 is partially received in the recess 214 of the bottom layer 213 of the shade body 21, and extends through the opening 111 and into the case body 11. In this embodiment, the connect member 23 has an outer shoulder surface 231 facing the inner flange 113 of the case body 11.

The power supply unit 3 includes a battery 31 and a charge port 32. The battery 31 is electrically connected the pushbutton switch 13 and the rotary switch 14. The charge port 32 is disposed on the case body 11, and is adapted to be electrically connected to an external power source (not shown) to supply electric power to said battery 31. In this embodiment, the charge port 32 is exemplified as a USB charge port (not shown), but may be changed according to practical requirements.

Figure 4:
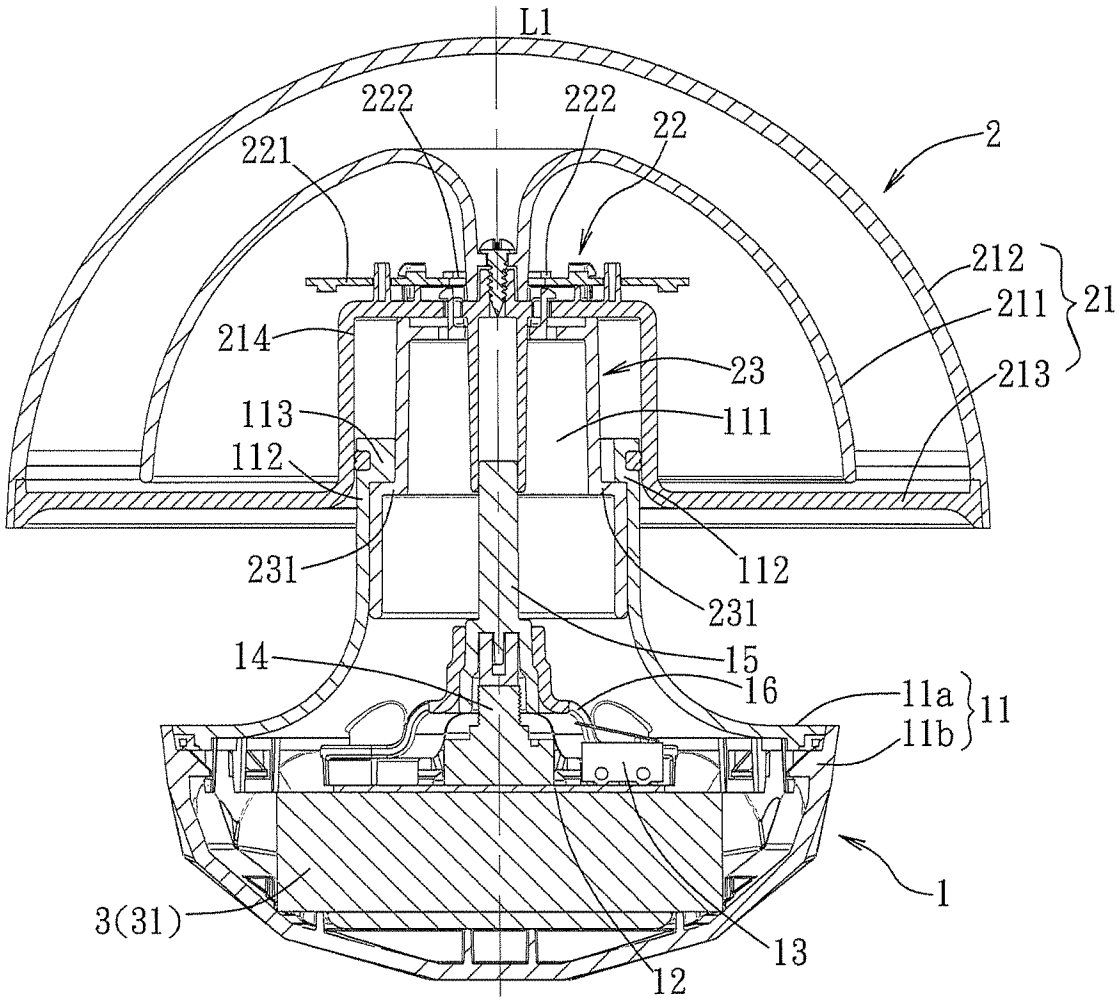
FIG. 4 is a sectional view of the embodiment when the shade unit is at the switch-on position.
Figure 5:
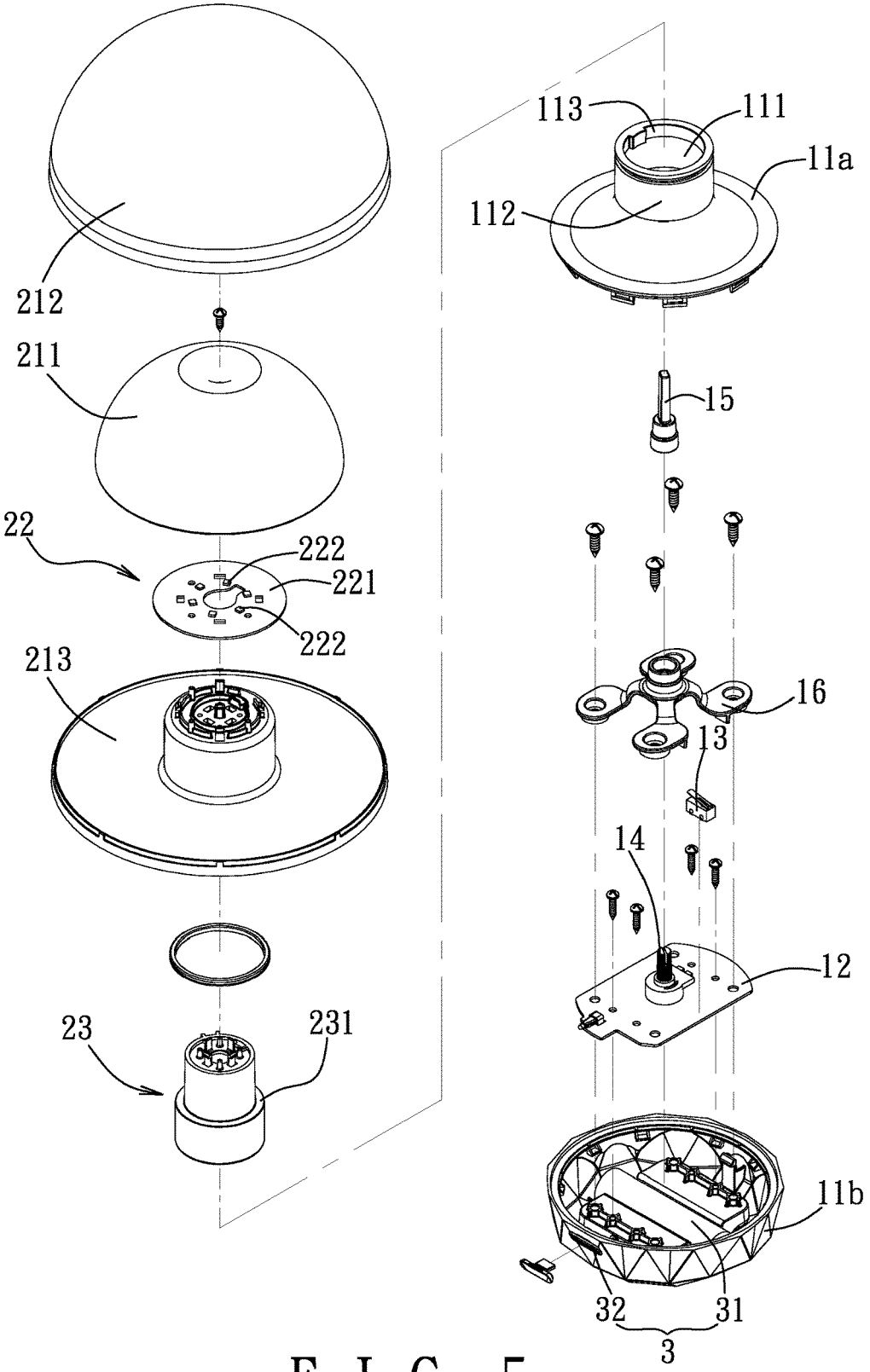
FIG. 5 is a partially exploded perspective view of the embodiment.

In this embodiment, the battery 31 of the power supply unit 3 is disposed on a bottom side of the first circuit board 12 (see FIGS. 2 and 4), and has a center of mass lying on the central axis (L1). With the curved bottom surface 114 of the lower case 11*b* and the center of mass of the battery 31 lying on the central axis (L1), the lamp of this discourse tends to seek an upright orientation when pushed over, resembling a roly-poly toy.

Referring to FIGS. 1 to 4, the shade unit 2 is slidable along the elongate interconnect member 15 relative to the case body 11 between a switch-on position (see FIGS. 3 and 4) and a switch-off position (see FIGS. 1 and 2). The shade unit 2 is movable in a first direction (D1) (see FIG. 3) to be converted from the switch-off position to the switch-on position, where the outer shoulder surface 231 of the connect member 23 abuts against the inner flange 113 of the case body 11, where the connect member 23 of the shade unit 2 is spaced apart from the pushbutton switch 13 so that the light module 22 is switched on and emits light, and where the shade body 21 is rotatable relative to the case body 11 to rotate the elongate interconnect member 15 and the rotary switch 14 to adjust brightness of the light module 22. Specifically, when the shade body 21 is rotated in a first rotating direction (R1) (see FIG. 3), the rotary switch 14 is co-rotated and the resistance is increased so that the brightness of the light module 22 is lowered. On the other hand, when the shade body 21 is rotated in a second rotating direction (R2) (see FIG. 3) opposite to the first rotating direction (R1), the rotary switch 14 is co-rotated and the resistance is decreased so that the brightness of the light module 22 is increased.

The shade unit 2 is movable in a second direction (D2) (see FIG. 3) opposite to the first direction (D1) to be converted from the switch-on position to the switch-off position, where the outer shoulder surface 231 of the connect member 23 is spaced apart from the inner flange 113 of the case body 11, and where the connect member 23 abuts against and presses the pushbutton switch 13 so that the light module 22 is switched off.

In summary, the slidable and rotatable design of the lamp according to the present disclosure allows the lamp to be easily switched on and off, and thus the brightness of the lamp can be easily adjusted. Moreover, the double layer design of the inner shade layer 211 and the outer shade layer 212 allows the light emitted by the light-emitting diodes 222 to be reflected and refracted therebetween, resulting in a softer light. In addition, the battery 31 of the power supply unit 3 can be charged through the charge port 32, and therefore can be reused multiple times.

In the description above, for the purposes of explanation, numerous specific details have been set forth in order to provide a thorough understanding of the exemplary embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed exemplary embodiment but is intended to cover various arrangements included within the spirit and scope of the broadest interpretation so as to encompass all such modifications and equivalent arrangements.

What is claimed is:

1. A lamp comprising:

a base unit including a case body that has an opening, a first circuit board that is disposed in said case body, a pushbutton switch that is disposed on said first circuit board, a rotary switch that is disposed on said first circuit board and that corresponds in position to said opening, and an elongate interconnect member that is co-rotatably connected to said rotary switch and that extends into said opening; and a shade unit including a shade body that is co-rotatably connected to said elongate interconnect member and that is slidable along said elongate interconnect member relative to said case body of said base unit, a light module that is disposed in said shade body, and that is electrically connected to said pushbutton switch and said rotary switch, and a connect member that extends from said shade body and that is movable toward and away from said pushbutton switch;

wherein said shade unit is slidable along said elongate interconnect member relative to said case body between a switch-on position, where said connect member is spaced apart from said pushbutton switch so that said light module is switched on and emits light and where said shade body is rotatable relative to said case body to rotate said elongate interconnect member and said rotary switch to adjust brightness of said light module, and a switch-off position, where said connect member abuts against said pushbutton switch so that said light module is switched off.

2. The lamp as claimed in claim 1, further comprising a power supply unit that includes a battery electrically connected to said pushbutton switch and said rotary switch.

3. The lamp as claimed in claim 2, wherein said power supply unit further includes a charge port that is disposed on said case body of said base unit, and that is adapted to be electrically connected to an external power source to supply electric power to said battery.

4. The lamp as claimed in claim 3, wherein said case body defines a central axis, said battery of said power supply unit being disposed on a bottom side of said first circuit board and having a center of mass lying on the central axis, said case body having a curved bottom surface.

5. The lamp as claimed in claim 4, wherein said shade body of said shade unit has an inner shade layer, and an outer shade layer spaced apart from and covering said inner shade layer.

6. The lamp as claimed in claim 4, wherein:

said case body of said base unit has an annular top end formed with an inner flange that surrounds said opening and that extends radially and inwardly toward the central axis;

said connect member having an outer shoulder surface facing said inner flange;

when said shade unit is at the switch-on position, said outer shoulder surface of said connect member abuts against said inner flange of said case body; and when said shade unit is at the switch-off position, said outer shoulder surface of said connect member is spaced apart from said inner flange of said case body.

7. The lamp as claimed in claim 4, wherein:

said case body of said base unit has an annular top end formed with an inner flange that surrounds said opening and that extends radially and inwardly toward the central axis;

said connect member having an outer shoulder surface facing said inner flange;

when said shade unit is at the switch-on position, said outer shoulder surface of said connect member abuts against said inner flange of said case body; and when said shade unit is at the switch-off position, said outer shoulder surface of said connect member is spaced apart from said inner flange of said case body.

8. The lamp as claimed in claim 1, wherein said light module includes a second circuit board and at least one light-emitting diode disposed on said second circuit board.

9. The lamp as claimed in claim 8, wherein said light module includes a plurality of said light-emitting diodes.

* * * * *